US011410809B2

(12) United States Patent
Park et al.

(10) Patent No.: US 11,410,809 B2
(45) Date of Patent: Aug. 9, 2022

(54) HIGH-SPEED SOLENOID

(71) Applicant: HYOSUNG HEAVY INDUSTRIES CORPORATION, Seoul (KR)

(72) Inventors: Hyo Geun Park, Tongyeong-si (KR); Young Jun Jeon, Gimhae-si (KR); Nak Geun Cho, Changwon-si (KR); Hyung Woo Park, Gimhae-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 164 days.

(21) Appl. No.: 16/957,267

(22) PCT Filed: Dec. 21, 2018

(86) PCT No.: PCT/KR2018/016409
§ 371 (c)(1),
(2) Date: Jun. 23, 2020

(87) PCT Pub. No.: WO2019/132436
PCT Pub. Date: Jul. 4, 2019

(65) Prior Publication Data

US 2020/0402694 A1 Dec. 24, 2020

(30) Foreign Application Priority Data

Dec. 28, 2017 (KR) ..... 10-2017-0183194

(51) Int. Cl.
*H01F 7/00* (2006.01)
*H01F 7/08* (2006.01)
(Continued)

(52) U.S. Cl.
CPC ..... *H01F 7/081* (2013.01); *H01F 7/1607* (2013.01); *H01F 27/325* (2013.01)

(58) Field of Classification Search
CPC ..... H01F 7/081; H01F 7/1607; H01F 27/325; H01F 7/0289; H01F 7/066; H01F 7/1615; H01F 27/02; H01F 27/323
(Continued)

(56) References Cited

U.S. PATENT DOCUMENTS 3,470,504 A * 9/1969 Mallory ..... H01H 51/065 335/78
3,728,654 A * 4/1973 Tada ..... H01F 7/1615 335/234
(Continued)

FOREIGN PATENT DOCUMENTS

JP 2001-217129 A 8/2001
KR 10-2012-0113889 A 10/2012
(Continued)

*Primary Examiner* — Shawki S Ismail
*Assistant Examiner* — Lisa N Homza
(74) *Attorney, Agent, or Firm* — Novick, Kim & Lee, PLLC; Jae Youn Kim

(57) ABSTRACT

A high-speed solenoid includes a casing, a least two pairs of first permanent magnet and second permanent magnet installed in the casing, and coils corresponding to the pairs of first permanent magnet and second permanent magnet provided in the same number as the number thereof in a bobbin of a mover. In magnetic paths formed by the pairs of first permanent magnet and second permanent magnet and the coils, each magnetic path corresponding to each pair of first permanent magnet and second permanent magnet is separated from each other. Therefore, the multiple magnetic paths are formed to operate the mover. The high-speed solenoid has an advantage in that the mover is operated at a relatively high speed.

8 Claims, 5 Drawing Sheets

(51) Int. Cl.
*H01F 7/16* (2006.01)
*H01F 27/32* (2006.01)

(58) Field of Classification Search
USPC ..... 335/226
See application file for complete search history.

(56) References Cited

U.S. PATENT DOCUMENTS 3,743,898 A * 7/1973 Sturman ..... H01F 7/1607 361/194
3,980,908 A * 9/1976 McClintock ..... G03B 7/083 396/465
3,987,383 A * 10/1976 Antonitsch ..... H01H 51/2272 335/78
4,001,844 A * 1/1977 McClintock ..... G03B 7/083 396/304
4,259,653 A * 3/1981 McGonigal ..... B41J 2/285 310/15
4,295,066 A * 10/1981 Lloyd ..... H01F 7/1615 310/30
4,306,207 A * 12/1981 Tada ..... H01F 7/1615 335/229
4,319,211 A * 3/1982 Ueda ..... G03B 9/08 335/229
4,358,691 A * 11/1982 Naylor ..... H01F 7/1615 310/12.04
4,419,643 A * 12/1983 Ojima ..... H01F 7/1615 335/230
4,422,060 A * 12/1983 Matsumoto ..... H01F 7/13 335/234
4,438,419 A * 3/1984 Helinski ..... H01F 7/1615 335/261
4,463,332 A * 7/1984 Everett ..... H01F 7/1615 335/258
4,490,815 A * 12/1984 Umehara ..... H01F 7/1615 335/234
4,751,487 A * 6/1988 Green, Jr. ..... H01F 7/1615 335/230
4,826,130 A * 5/1989 Griffith ..... H01F 7/1607 251/129.14
4,845,392 A * 7/1989 Mumbower ..... H01F 7/13 310/14
4,892,285 A * 1/1990 Torrence ..... F25B 41/31 251/129.05
4,994,776 A * 2/1991 Juncu ..... H01F 7/1615 335/230
5,108,070 A * 4/1992 Tominaga ..... F16K 31/0613 251/65
5,272,458 A * 12/1993 Hoffman ..... H01H 51/2209 335/179
5,814,907 A * 9/1998 Bandera ..... H01F 7/088 310/105
5,896,076 A * 4/1999 van Namen ..... H01F 7/1615 335/229
6,124,771 A * 9/2000 Kim ..... H01H 50/646 335/4
6,265,956 B1 * 7/2001 Cascolan ..... H01F 7/1615 335/234
6,639,496 B1 * 10/2003 van Namen ..... E05B 47/00 335/229
6,791,442 B1 * 9/2004 Schmidt ..... H01F 7/1615 335/220
7,078,833 B2 * 7/2006 Xu ..... H01F 7/14 310/12.33
8,928,436 B2 * 1/2015 Hirabayashi ..... H01H 50/023 335/131
9,368,266 B2 * 6/2016 Mailer ..... H01H 50/14
10,697,477 B2 * 6/2020 Sakashita ..... F16K 31/061
2003/0222534 A1 * 12/2003 Xu ..... H01F 7/14 310/14
2004/0227604 A1 * 11/2004 Mitteer ..... H01F 7/088 335/220
2005/0024174 A1 * 2/2005 Kolb ..... H01F 7/1615 335/220
2005/0052265 A1 * 3/2005 Vladimirescu .... H01H 51/2209 335/229
2006/0255892 A1 * 11/2006 Adams ..... H01F 7/1615 335/264
2008/0297288 A1 * 12/2008 Irwin ..... H01F 7/1615 335/254
2009/0072636 A1 * 3/2009 Gruden ..... H01F 7/1615 310/14
2010/0097165 A1 * 4/2010 Schilling ..... H01F 7/1615 335/257
2010/0156582 A1 * 6/2010 Zelmer ..... F16H 63/48 335/261
2013/0214886 A1 * 8/2013 Ohtsuka ..... H01H 3/46 335/189
2013/0241680 A1 * 9/2013 Hanchett, Jr. ..... H01F 7/16 335/234
2014/0354381 A1 * 12/2014 Kohlhafer ..... H01F 7/081 335/179
2015/0102878 A1 * 4/2015 Shin ..... H01F 7/1607 335/279
2015/0233488 A1 * 8/2015 Holmes ..... F16K 31/0655 251/129.07
2016/0020010 A1 * 1/2016 Mailer ..... H01H 50/30 335/261
2016/0125991 A1 * 5/2016 Wardle ..... F01L 13/0036 335/232
2016/0125992 A1 * 5/2016 Irwin ..... H01F 7/1607 335/253
2016/0172137 A1 * 6/2016 Liang ..... H01F 7/1615 335/179
2017/0133138 A1 * 5/2017 Bye ..... G01D 5/145
2017/0154716 A1 * 6/2017 McLauchlan ..... F16K 31/54
2017/0159844 A1 * 6/2017 Fujita ..... F16K 31/082
2018/0017158 A1 * 1/2018 Lee ..... H01F 7/1615
2019/0178265 A1 * 6/2019 Sakashita ..... F16K 31/061
2019/0287705 A1 * 9/2019 Pellmann ..... H01F 7/122
2020/0131685 A1 * 4/2020 Lee ..... H01F 27/325

FOREIGN PATENT DOCUMENTS

KR 10-1547950 B1 8/2015
KR 10-1552573 B1 9/2015
KR 10-1668047 B1 10/2016

* cited by examiner

HIGH-SPEED SOLENOID

TECHNICAL FIELD

The present invention relates generally to a high-speed solenoid. More particularly, the present invention relates to a high-speed solenoid, which allows rectilinear motion of a predetermined stroke to be performed by using a permanent magnet.

BACKGROUND ART

In a solenoid, a mover performs rectilinear motion due to a current flowing through a coil so as to convert magnetic energy into kinetic energy. Such a solenoid is used in various fields such as power equipment, automobiles, and hydraulic systems.

Generally, the solenoid has a movable iron core arranged in the center thereof, and allows the movable iron core to perform rectilinear motion while magnetic fields generated by electric currents applied to coils form magnetic paths along inner iron cores.

Here, to increase the reaction speed of the movable iron core, the weight of the movable iron core, which is a moving part, is required to be light. However, in the related art, the movable iron core cannot have good reactiveness although the movable iron core has a relatively low weight, so there is limitation in increasing the operation speed of the solenoid.

DISCLOSURE

Technical Problem

An objective of the present invention is to solve the above problems occurring in the related art, and to propose a solenoid that operates at high speed by using a permanent magnet.

Another objective of the present invention is to minimize the weight of a mover.

Still another objective of the present invention is to prevent the generation of withstand voltage in a bobbin and a coil.

Technical Solution

According to the characteristics of the present invention in order to accomplish the above objectives, the present invention provides a high-speed solenoid including: a casing having predetermined space provided therein and functioning to form a magnetic path; at least two pairs of first permanent magnet and second permanent magnet securely provided inside the casing; and a mover having a bobbin provided with a coil and made of a synthetic resin material, the coil corresponding to each of the pairs of first permanent magnet and second permanent magnet being provided in the same number as the number thereof, and forming multiple magnetic paths through electromagnetic interaction with the pairs of first permanent magnet and second permanent magnet.

A guide having a guide through-hole may be provided in the casing to guide movement of the mover, and a movable pin provided in a center of the bobbin may be positioned in the guide through-hole.

Polarities of the first permanent magnet and the second permanent magnet and a winding direction of the coil may be set such that adjacent magnetic paths in the magnetic paths formed between each of the pairs of first permanent magnet and second permanent magnet and the coil are formed in directions opposite to each other.

A dividing plate may be positioned between each of the pairs of first permanent magnet and second permanent magnet, and may provide space dividing the magnetic paths formed in each of the pairs of first permanent magnet and second permanent magnet adjacent to each other.

The casing and the dividing plate may be made of the same material.

An entirety of an end part of the casing may be open, and a cover may be mounted to the end part to cover an inside of the casing from the outside.

A fastener may pass through the cover and may be fastened to a topmost dividing plate such that the cover is coupled to the casing.

A groove may be provided in an outer surface of the bobbin, the coil surrounding the outer surface of the bobbin being seated in the groove, a primary coating layer made of an insulation material may be provided on an entirety of the outer surface of the bobbin, and a secondary coating layer made of an insulation material may be provided on a surface of the coil on which the coil is wound in the groove and then exposed to an outside of the groove.

The bobbin may be configured to have a shape of a cylinder open at a side thereof.

Advantageous Effects

The high-speed solenoid according to the present invention can obtain the following effects.

In the present invention, the permanent magnet is provided in the casing, and the coil is provided on the bobbin of the mover to operate the mover through electromagnetic interaction therebetween. In this case, the permanent magnet and the coil are provided in multiple pairs to interact with each other, so initial responsiveness is increased. Accordingly, multiple magnetic paths are formed and allow the mover to operate at a relatively high speed.

In the present invention, the bobbin on which the coil is installed is made of a plastic material, so the weight of the mover is relatively decreased and thus the moving speed of the mover can be relatively increased.

In addition, in the present invention, to prevent the generation of withstand voltage with respect to the coil installed on the bobbin, a coating layer made of an insulation material is primarily formed on the outer surface of the bobbin, and a coating layer made of an insulation material is secondarily formed on the portion of the coil in which the coil is wound on the bobbin and then is exposed to the outside. Accordingly, the performance of preventing the generation of the withstand voltage with respect to the coil in the bobbin is improved.

MODE FOR INVENTION

Figure 1:
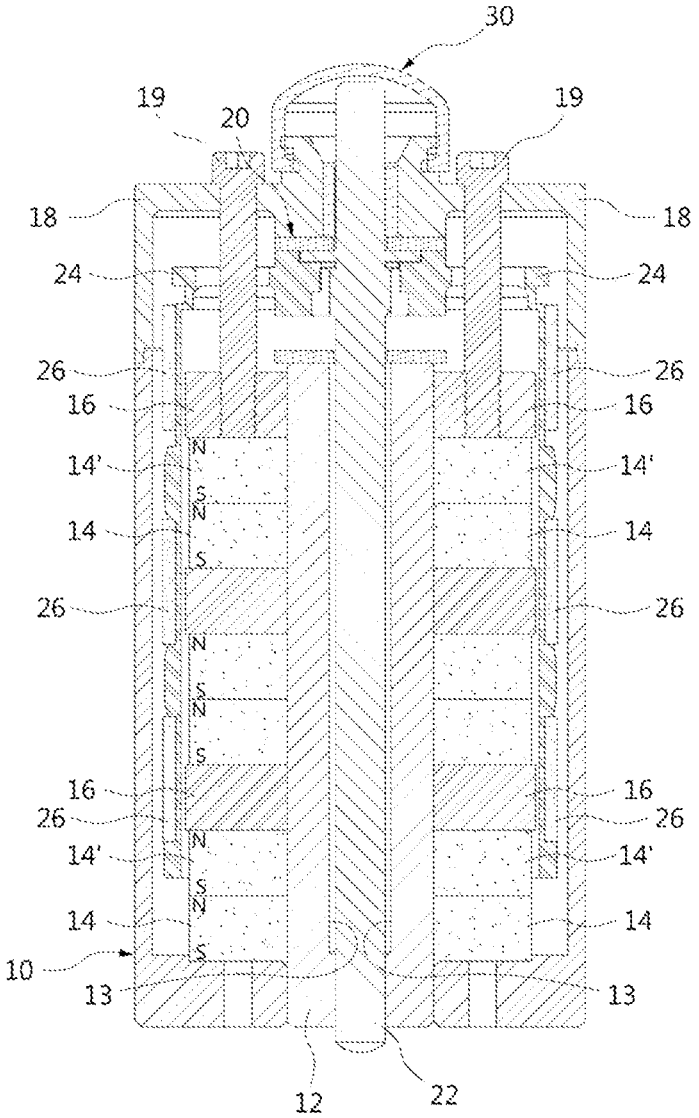
FIG. 1 is a sectional view illustrating the configuration of a high-speed solenoid according to an exemplary embodiment of the present invention.

Hereinbelow, an embodiment of the present invention will be described in detail with reference to the accompanying drawings. It should be noted that in adding reference numerals to the components of each drawing, the same components have the same reference numerals as possible even though they are displayed on different drawings. In addition in describing the embodiment of the present invention, when it is determined that detailed descriptions of related well-known structures or functions hinder understanding of the embodiment of the present invention, detailed descriptions thereof will be omitted.

In addition, in describing the components of the embodiment of the present invention, terms such as first, second, A, B, (a), and (b) may be used. These terms are only for distinguishing the components from other components, and the nature or order of the components is not limited by the terms. When a component is described as being "connected" or "coupled" to another component, the component may be directly connected to or coupled to the another component, but it should be understood that still another component may be "connected" or "coupled" thereto between components.

As illustrated in the drawings, a casing 10 constitutes the appearance of a high-speed solenoid of the present invention. Predetermined space is provided inside the casing 10, and components to be described below are provided therein. Although the casing 10 constitutes the appearance, the casing 10 is made of a material having a high magnetizing force, and thus forms an outer magnetic path. Carbon steel may be used as the material for the casing 10. The casing 10 may be made in various shapes, but has a cylindrical shape in the embodiment. A first end part of the casing 10 is open only in a portion thereof, but the second end part thereof is entirely open. At the second end part, which is entirely open, the inner space of the casing 10 is shielded from the outside by a cover 18 to be described below.

A guide 12 is provided inside the casing 10. An end part of the guide 12 is fixed to the first end part of the casing 10, which is partially open. Threaded parts are formed on the outer surface of the end part of the guide 12 and the inner surface of the first end part of the casing 10, which is partially open so as to fasten the guide 12 and the casing 10. A guide through-hole 13 is formed through the inside of the guide 12. A movable pin 22 of a mover 20 to be described below is provided in the guide through-hole 13.

At least two pairs of first permanent magnet 14 and second permanent magnet 14', which constitute one pair, are installed inside the casing 10 such that the guide 12 passes through the centers thereof. That is, the first permanent magnet 14 and the second permanent magnet 14' having ring shapes are provided in a pair. In the embodiment, three pairs of first permanent magnet 14 and second permanent magnet 14' are provided. Dividing plates 16 are provided to define space dividing magnetic paths by dividing each of the pairs of first permanent magnet 14 and second permanent magnet 14' therebetween. In the embodiment, each of the dividing plates 16 is provided on each pair of first permanent magnet 14 and second permanent magnet 14'.

Figure 4:
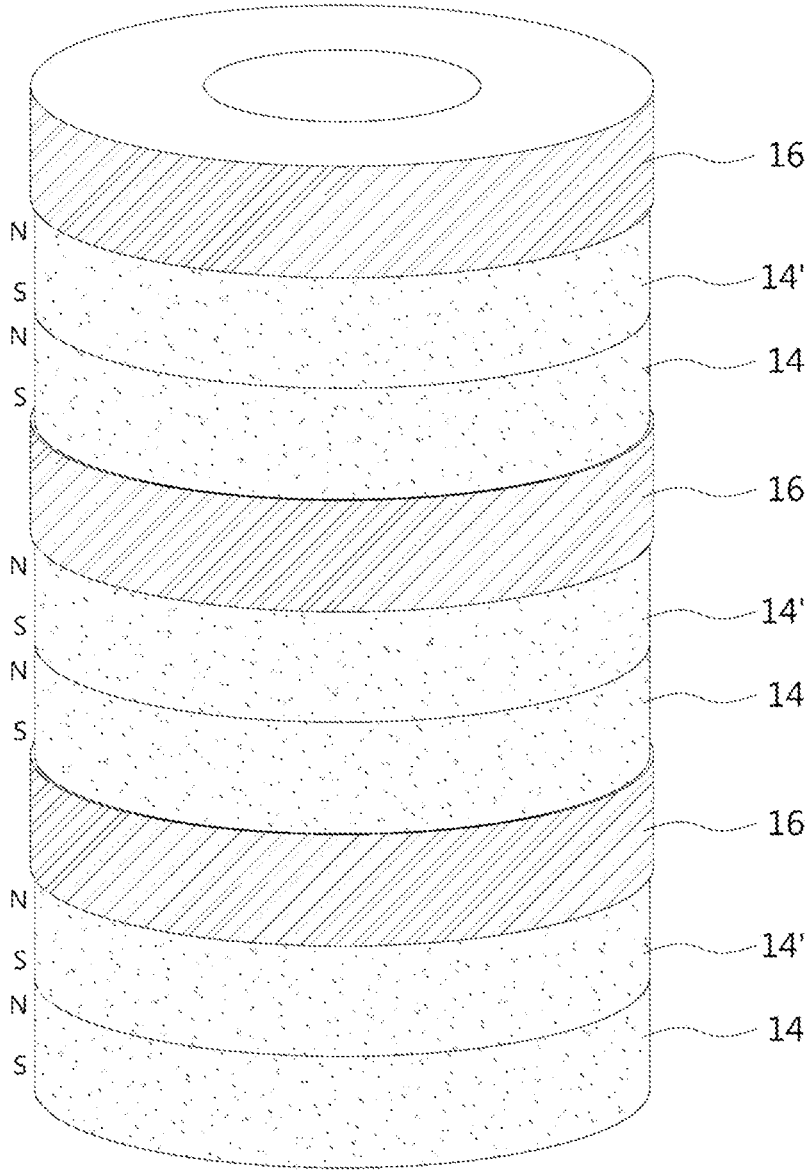
FIG. 4 is a perspective view illustrating the arranged state of permanent magnets in the embodiment of the present invention.

Each pair of first permanent magnet 14 and second permanent magnet 14' of a position at which each of the pairs of first permanent magnet 14 and second permanent magnet 14' is divided by the dividing plate 16 is configured to have polarity opposite to each other as illustrated in FIG. 4. This is intended to divide magnetic paths formed by these pairs of first permanent magnet 14 and second permanent magnet 14'. Furthermore, different polarities are in contact with each other in each pair of first permanent magnet 14 and second permanent magnet 14' so that an attractive force acts between the first permanent magnet 14 and the second permanent magnet 14'. For reference, the dividing plate 16 is preferably made of the same material as the material of the casing 10. This is because the casing 10 and the dividing plate 16 function to form a magnetic path.

The cover 18 is mounted to the open second end part of the casing 10. The cover 18 is made of aluminum. The cover 18 may be considered to be a part of the casing 10. A fastener 19 passes through the cover 18 and is fastened to the dividing plate 16. For reference, the pairs of first permanent magnet 14 and second permanent magnet 14' and the dividing plate 16 are fixed to the inside of the casing 10 by the end part of the guide 12, and the fastener 19 is fastened to one of the dividing plates 16 such that the cover 18 is coupled to the casing 10.

The mover 20 is provided inside the casing 10. The mover is positioned in space between the inner surface of the casing 10 and the outer surface of the first permanent magnet 14, the second permanent magnet 14', and the dividing plate 16, and in space defined by the cover 18. The mover 20 performs rectilinear motion by a predetermined distance.

The movable pin 22 is provided in the mover 20. A first end part of the movable pin 22 is configured to protrude toward the outside of the casing 10. The movable pin 22 provides power to move another part connected to the first end part protruding to the outside of the casing 10. The movable pin 22 is made of a stainless material.

The movable pin 22 is mounted to a bobbin 24. The bobbin 24 is made of a synthetic resin material. An end part of the bobbin 24 is coupled to the movable pin 22, and the bobbin 24 is formed to have a cylindrical shape. The cylindrical portion of the bobbin 24 formed in the cylindrical shape is located in the space between the inner surface of the casing 10 and the outer surface of the first permanent magnet 14 and the second permanent magnet 14'.

A groove 25 having a predetermined shape is formed in the bobbin 24 by surrounding the outer surface thereof, and a coil 26 is positioned in the groove. The number of the coil 26 is the same as the number of the pair of first permanent magnet 14 and second permanent magnet 14' such that the coil 26 corresponds to the pair of first permanent magnet 14 and second permanent magnet 14'. In the embodiment, three coils 26 are provided on the bobbin 24. In each of the coils 26 provided on the bobbin 24, coils adjacent to each other are provided to have opposite winding directions. This is to allow the magnetic paths formed in the adjacent coils 26 to be separated from each other.

Figure 5:
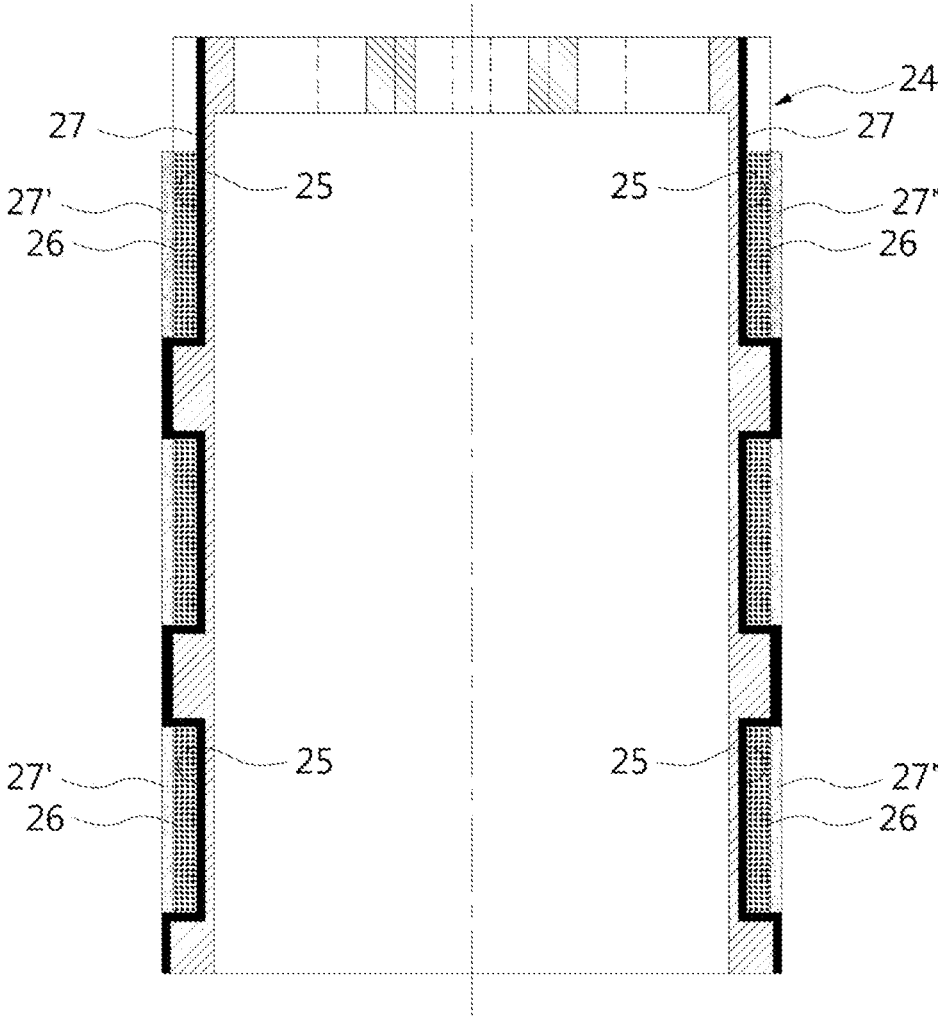
FIG. 5 is a sectional view illustrating the configuration of a bobbin constituting a high-speed solenoid according to the embodiment of the present invention.

Before the coil 26 is installed on the outer surface of the bobbin 24, a primary coating layer 27 is formed on the entirety of the outer surface. The primary coating layer 27 is formed on the entire outer surface of the bobbin 24 in addition to portions illustrated in FIG. 5.

In addition, a secondary coating layer 27' is formed on the outer surface of the coil 26 seated in the groove 25 of the bobbin 24. Accordingly, insulation between the coils 26 and parts adjacent thereto can be reliably achieved by an insulating coating formed by surrounding the outer surface of the coil 26 exposed to the outside of the groove 25. Accordingly, the generation of withstand voltage in the bobbin 24 can be prevented by the formation of the primary coating layer 27 and the secondary coating layer 27'.

Meanwhile, the first end part of the movable pin 22 of the mover 20 is connected to the another part as described above, but the second end part thereof is shielded by a cap 30 as illustrated in FIG. 1. The cap 30 is made of a rubber material, and shields the second end part of the movable pin 22, so foreign matter is prevented from entering the inside of the casing 10 along the movable pin 22.

Hereinafter, the manufacturing and use of the high-speed solenoid of the present invention having the above-described configuration will be described in detail.

In the present invention, fixture is provided inside the casing 10, and the pair of first permanent magnet 14 and second permanent magnet 14' and the dividing plate 16 are sequentially positioned in the fixture. In this case, the polarities of the first permanent magnet 14 and the second permanent magnet 14' are set as illustrated in FIG. 4. Accordingly, when the pairs of first permanent magnet 14 and second permanent magnet 14' and the dividing plates 16 are all installed, the guide 12 is inserted into the casing 10. In this case, the guide 12 is installed by passing through the centers of the pairs of first permanent magnet 14 and second permanent magnet 14' and the dividing plates 16, and the lower part of the guide 12 is screwed to the casing 10.

Next, the mover 20 is installed. The bobbin 24, on which the coil 26 is wound, is positioned in the space between the outer surface of the first permanent magnet 14, the second permanent magnet 14', and the dividing plate 16 and the inner surface of the casing 10, and the movable pin 22 is inserted into the guide through-hole 13 of the guide 12.

After the mover 20 is assembled, the cover 18 is mounted to the casing and is fastened by the fastener 19. The fastener 19 passes through the cover 18, and is fastened to a topmost dividing plate 16. After the assembly of the cover 18, the cap 30 is installed.

In the present invention, the distance of the moving stroke of the mover 20 is A illustrated in FIG. 1. While the movable pin 22 is moved together by the moving stroke of the mover 20, the movement of the part connected to the first end part of the movable pin 22 is performed.

Figure 2:
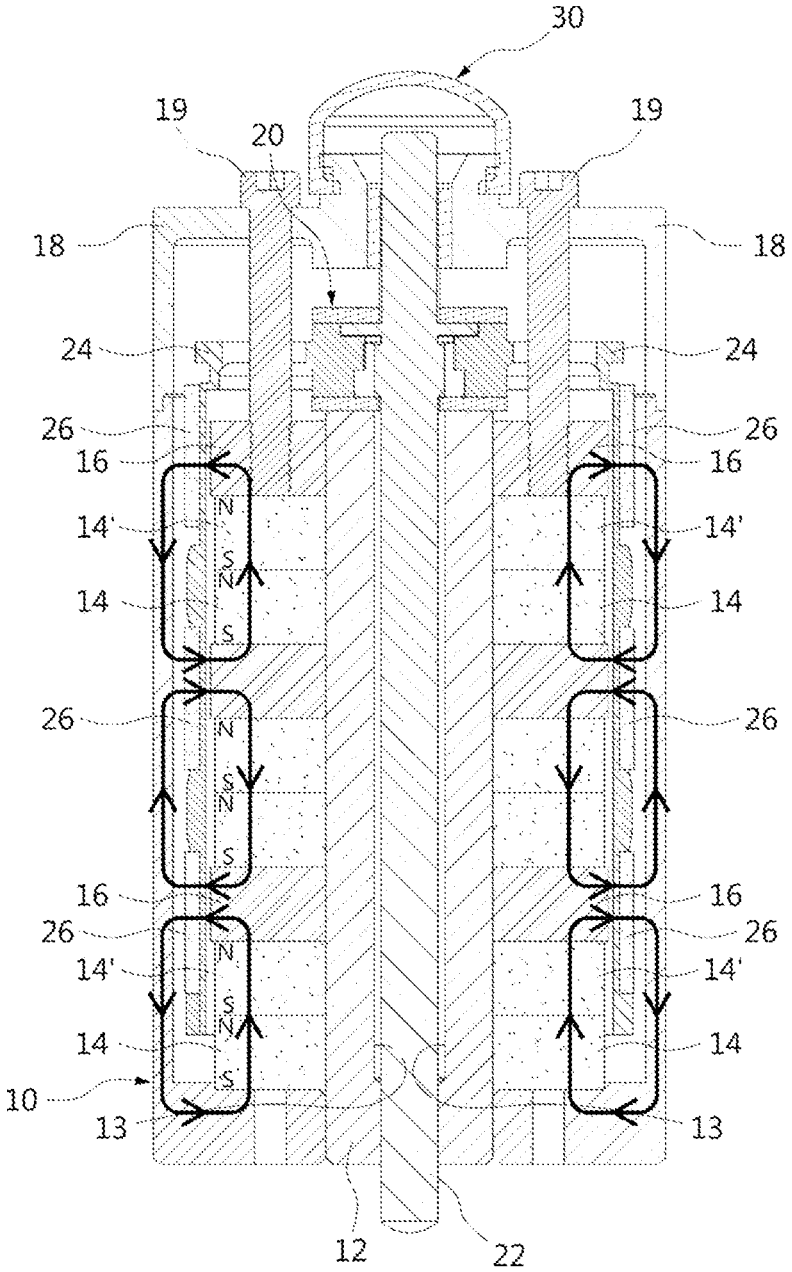
FIG. 2 is a sectional view illustrating magnetic paths formed in the embodiment of the present invention.

In the present invention, when power is applied to the coils 26, the formation of the magnetic paths is illustrated in FIG. 2. The number of the magnetic paths is the same as the number of the pairs of first permanent magnet 14 and second permanent magnet 14', or the number of the coils 26. Accordingly, in the embodiment, three separate magnetic paths are formed. Each of the magnetic paths is formed such that electric current passes through the first permanent magnet 14 and the second permanent magnet 14' via the casing 10, and to flow back to the casing 10. Here, the direction of the magnetic path can be set according to the direction of the power given to the coil 26.

Accordingly, the mover 20 can be moved by a force produced while the magnetic paths are formed. When the mover 20 moves, the movable pin 22 also moves together therewith. In the present invention, the first permanent magnet 14 and the second permanent magnet 14' are used as fixed magnetic force providers. Accordingly, when the first permanent magnet 14 and the second permanent magnet 14 are used instead of an electromagnet, a relatively rapid operation of the mover can be performed. This is because the permanent magnet has a relatively good initial responsiveness.

In the embodiment, three pairs of first permanent magnet 14 and second permanent magnet 14' are provided. Accordingly, three magnetic paths are also formed separately. Furthermore, these three magnetic paths are separately distributed over almost the entire area of the mover 20. Accordingly, the mover 20 can be moved more rapidly and reliably.

Figure 3:
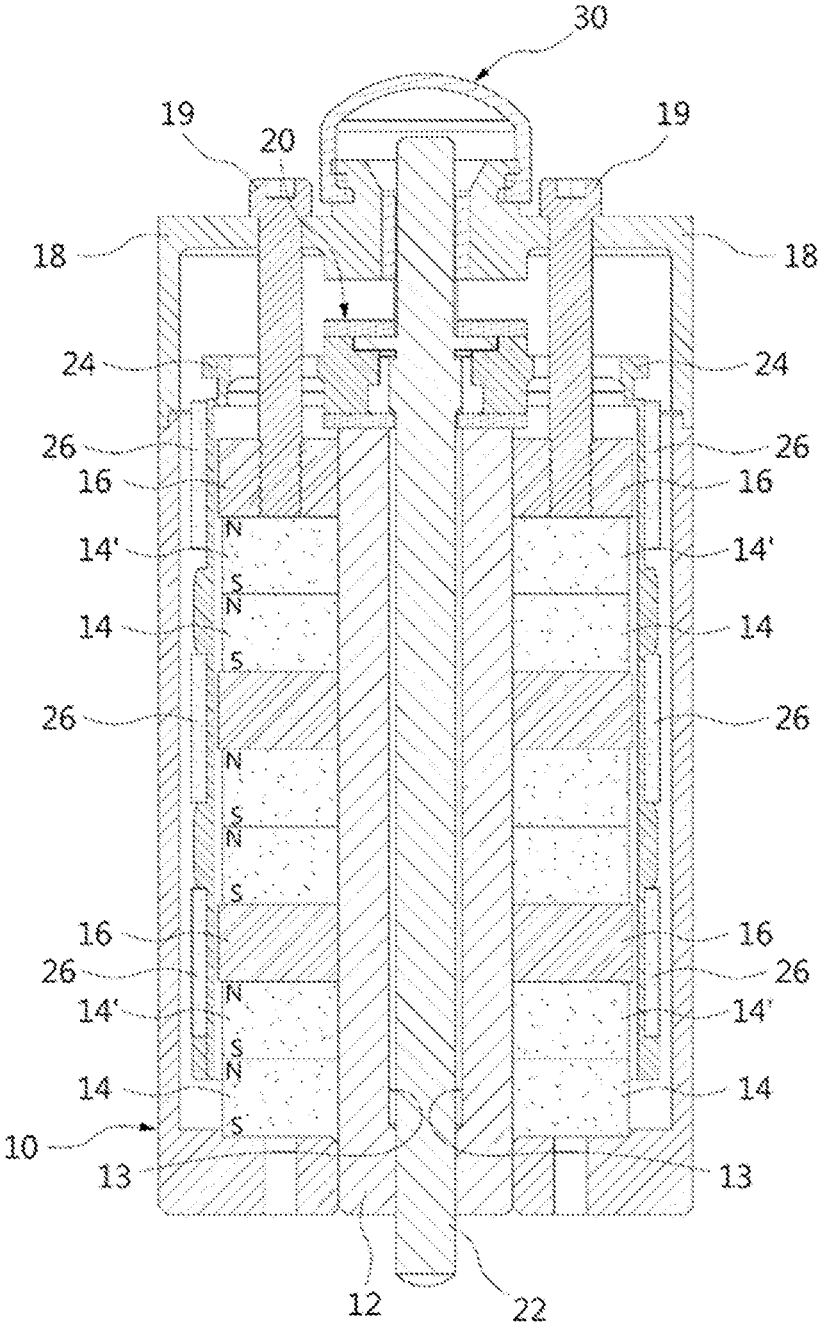
FIG. 3 is a sectional view illustrating the state of a mover operated in the embodiment of the present invention.

The state of the movable pin 22 further protruded to the outside of the casing 10 by the movement of the mover 20 is illustrated in FIG. 3. For reference, placing the movable pin 22 in the state illustrated in FIG. 1 can be performed by using a separate hydraulic drive source. That is, as illustrated in FIG. 1, the movable pin 22 is manipulated by using the separate hydraulic drive source so that the movable pin 22 is in a correct position.

When an operation signal occurs in this state, power is applied to the coil 26, and the magnetic field is generated accordingly, so the magnetic paths as illustrated in FIG. 2 are formed. Accordingly, a force to move the mover 20 is generated by the formation of the magnetic paths. The mover 20 is operated by the force, and the movable pin 22 is brought to the state illustrated in FIG. 3. Changing the position of the movable pin 22 of FIG. 3 to the position of the movable pin 22 of FIG. 1 can be achieved by blocking the power applied to the coil 26 and manipulating the movable pin 22 by using the hydraulic drive source.

In the above, all the components constituting the embodiment of the present invention are described as being coupled to each other as one or being operated in the coupled state, but the present invention is not necessarily limited to the embodiment. That is, if it is within the scope of the present invention, at least one of all of the components may be selectively combined and operated. In addition, the terms such as "include", "compose", or "have" as described above means that the corresponding components can be inherent unless specifically stated to the contrary. Accordingly, it should be interpreted that other components are not excluded, but may further be included. All terms, including technical or scientific terms, have the same meaning as generally understood by those skilled in the art to which the present invention belongs, unless otherwise defined. Commonly used terms, such as predefined terms, should be interpreted as being consistent with the contextual meaning of the related art, and are not to be interpreted as ideal or excessively formal meanings unless explicitly defined in the present invention.

The above description is only to illustrate the technical idea of the present invention, but those skilled in the art to which the present invention pertains will be able to make various modifications and variations without departing from the essential characteristics of the present invention. Accordingly, the embodiment disclosed in the present invention is not intended to limit the technical spirit of the present invention, but to explain it, and the scope of the technical spirit of the present invention is not limited to the embodiment. The scope of protection of the present invention should be interpreted by the scope of the claims below, and all technical spirits within the scope equivalent thereto should be interpreted as being included in the scope of the claims of the present invention.

The invention claimed is:

1. A high-speed solenoid comprising:

a casing having predetermined space provided therein and functioning to form a magnetic path;

at least two pairs of first permanent magnet and second permanent magnet securely provided inside the casing; and a mover having a bobbin provided with a coil and made of a synthetic resin material, the coil corresponding to each of the pairs of first permanent magnet and second permanent magnet being provided in the same number as the number thereof, and forming each of multiple magnetic paths through electromagnetic interaction with the pairs of first permanent magnet and second permanent magnet, wherein a dividing plate is positioned between each of the pairs of first permanent magnet and second permanent magnet, and provides a space dividing the magnetic paths and formed in the pairs of first permanent magnet and second permanent magnet adjacent to each other, respectively.

2. The high-speed solenoid of claim 1, wherein a guide having a guide through-hole is provided in the casing to guide movement of the mover, and a movable pin provided in a center of the bobbin is positioned in the guide through-hole.

3. The high-speed solenoid of claim 2, wherein polarities of the first permanent magnet and the second permanent magnet and a winding direction of the coil are set such that adjacent magnetic paths in the magnetic paths formed between each of the pairs of first permanent magnet and second permanent magnet and the coil are formed in directions opposite to each other.

4. The high-speed solenoid of claim 1, wherein the casing and the dividing plate are made of the same material.

5. The high-speed solenoid of claim 4, wherein an entirety of an end part of the casing is open, and a cover is mounted to the end part to cover an inside of the casing from the outside.

6. The high-speed solenoid of claim 5, wherein a fastener passes through the cover and is fastened to a topmost dividing plate such that the cover is coupled to the casing.

7. A high-speed solenoid comprising:

a casing having predetermined space provided therein and functioning to form a magnetic path;

at least two pairs of first permanent magnet and second permanent magnet securely provided inside the casing; and a mover having a bobbin provided with a coil and made of a synthetic resin material, the coil corresponding to each of the pairs of first permanent magnet and second permanent magnet being provided in the same number as the number thereof, and forming each of multiple magnetic paths through electromagnetic interaction with the pairs of first permanent magnet and second permanent magnet, wherein a groove is provided in an outer surface of the bobbin, the coil surrounding the outer surface of the bobbin being seated in the groove, a primary coating layer made of an insulation material is provided on an entirety of the outer surface of the bobbin, and a secondary coating layer made of an insulation material is provided on a surface of the coil on which the coil is wound in the groove and then exposed to an outside of the groove.

8. The high-speed solenoid of claim 7, wherein the bobbin is configured to have a shape of a cylinder open at a side thereof.

* * * * *